US005218912A

United States Patent [19]

Buske

[11] Patent Number: 5,218,912

[45] Date of Patent: Jun. 15, 1993

[54] COMBINATION STORAGE CONTAINER AND PLAY TABLE FOR INTERLOCKING BUILDING BLOCKS

[76] Inventor: Brian Scott Buske, 2500 Central Pkwy., Ste. P, Houston, Tex. 77092

[21] Appl. No.: 832,787

[22] Filed: Feb. 7, 1992

[51] Int. Cl.[5] ..... A47B 85/00

[52] U.S. Cl. ..... 108/26; 108/14

[58] Field of Search ..... 108/25, 26, 38, 75, 108/36, 34, 115, 129, 130; 312/258

[56] References Cited

U.S. PATENT DOCUMENTS

| | | | |
|---|---|---|---|
| D. 252,977 | 9/1979 | Bayly . | |
| D. 252,979 | 9/1979 | Bayly . | |
| D. 318,960 | 8/1991 | Lilly et al. . | |
| 1,975,595 | 10/1934 | Wadkins | 108/14 |
| 2,131,122 | 9/1938 | Schcott | 108/14 |
| 2,363,699 | 11/1944 | Smith . | |
| 2,683,639 | 7/1954 | Brenny . | |
| 2,956,849 | 10/1960 | Dow . | |
| 2,986,438 | 5/1961 | Smathers et al. . | |
| 3,148,636 | 9/1964 | Bloomquist et al. . | |
| 3,271,075 | 9/1966 | Good | 108/129 X |
| 3,759,192 | 9/1973 | Oehler . | |
| 3,859,930 | 1/1975 | Sherwin . | |
| 3,939,976 | 2/1976 | VanIseghem, Jr. . | |
| 3,990,727 | 11/1976 | Gallagher . | |
| 4,010,696 | 3/1977 | Priesman . | |
| 4,052,944 | 10/1977 | Jennings . | |
| 4,095,533 | 6/1978 | Leveille | 108/76 X |
| 4,378,818 | 4/1983 | Shiminski | 108/35 X |
| 4,548,440 | 10/1985 | Meslin et al. . | |
| 4,662,676 | 5/1987 | Havelock . | |
| 4,747,352 | 5/1988 | Guidry et al. . | |
| 4,872,410 | 10/1989 | Lilly | 108/26 |
| 4,926,758 | 5/1990 | Lilly . | |
| 4,972,701 | 11/1990 | Montgomery et al. | 108/25 |
| 5,055,081 | 10/1990 | Mayak | 108/26 X |

FOREIGN PATENT DOCUMENTS

| | | | |
|---|---|---|---|
| 817148 | 7/1969 | Canada . | |
| 438147 | 12/1926 | Fed. Rep. of Germany . | |
| 2101297 | 7/1971 | Fed. Rep. of Germany . | |
| 932262 | 7/1963 | United Kingdom | 108/14 |
| 1049484 | 11/1966 | United Kingdom . | |

OTHER PUBLICATIONS

Shellcore Inc. (S. Plainfield, N.J.) "Sit'n Build".

*Primary Examiner*—Jose V. Chen
*Attorney, Agent, or Firm*—Vaden, Eickenroht, Thompson, Boulware & Feather

[57] ABSTRACT

A laptop, transportable play table having a top, playing surface which is compatible with the interlocking building blocks made by several children's toy manufacturers and folding legs which form the storage container for the building blocks when they are not being played with. The apparatus forms a stable playing table for use in situations and locations in which a child might not otherwise be able to play with such building blocks while also providing storage for the building blocks when they are not being played with, all in one apparatus which is sturdy and easily transportable.

4 Claims, 2 Drawing Sheets

FIG. 1
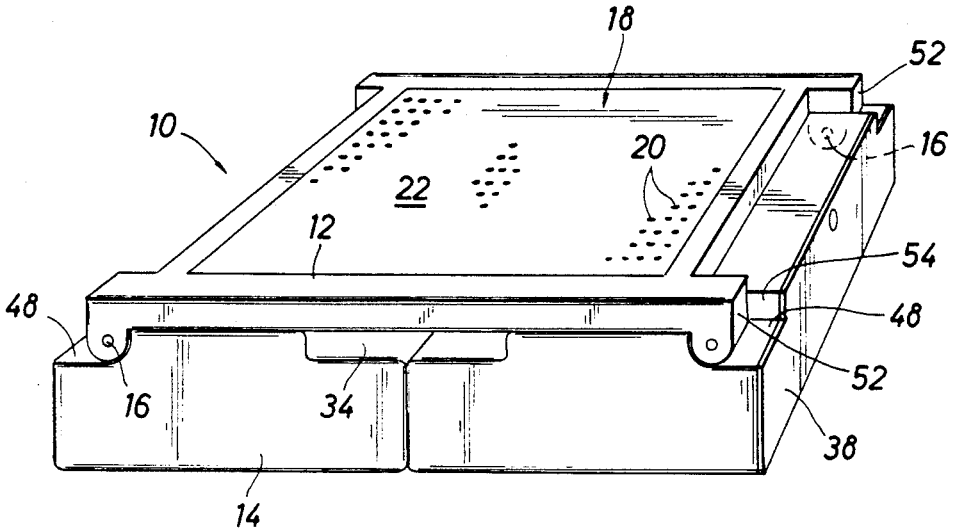
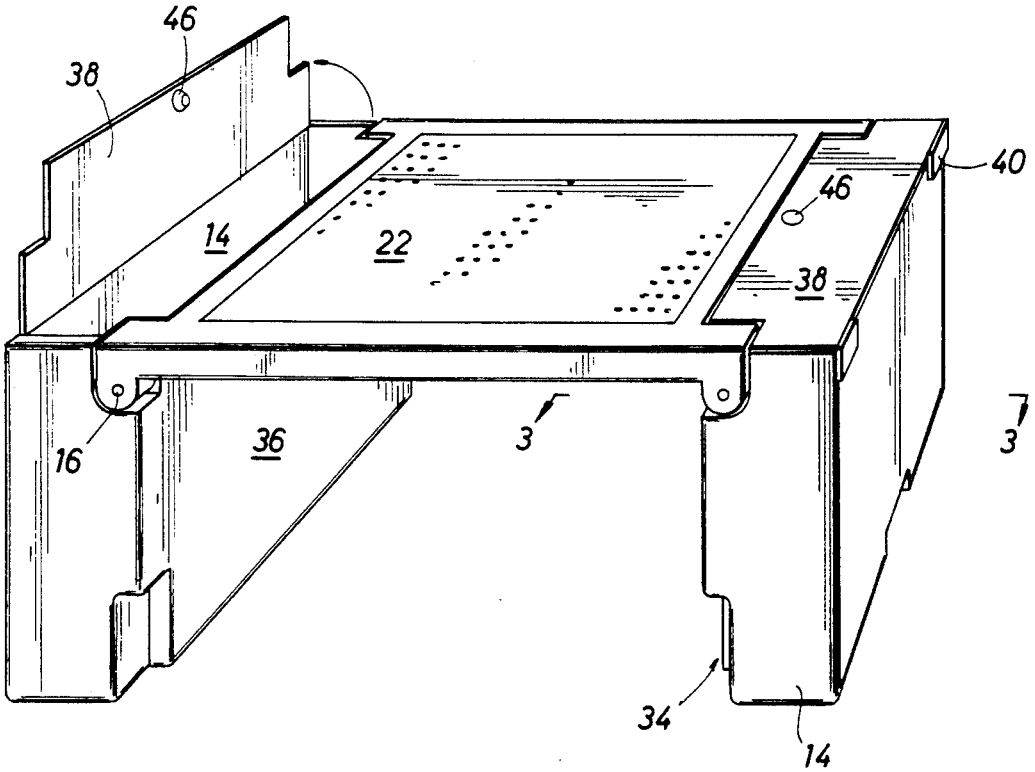
FIG. 2

COMBINATION STORAGE CONTAINER AND PLAY TABLE FOR INTERLOCKING BUILDING BLOCKS

BACKGROUND OF THE INVENTION

The present invention relates to an apparatus for use in connection with children's interlocking building blocks. More particularly, the present invention relates to a combination of a storage container and play table for use in connection with children's interlocking building blocks.

Interlocking building blocks of the type sold under the trademarks TYCO, DUPLO, LEGO, and TANDEM have for many years been a popular children's toy. Because such blocks are excellent teaching tools, it is desirable to encourage children to play with them, and to that end, a product has been sold under the mark TABLE TOYS since 1989 which is intended to provide such encouragement. That product comprises a table having plates inset into the top thereof having projections for interdigitating with such building blocks molded therein so that the children are encouraged to erect various structures on the table top with those blocks, using the projections on the plates of these tables to stabilize the structure on the table. Of course such blocks also have a habit of disappearing and/or constantly being under foot, and so the product sold under the mark TABLE TOYS is provided with a cutout in the center of the table surface having a bag attached to the table underneath that cutout for storing the interlocking building blocks. This product has enjoyed considerable success and acceptance in the marketplace.

However, the product sold under the mark TABLE TOYS is not portable in the sense that it is not easily transportable from place to place. Nevertheless, children can be entertained for hours with such interlocking building blocks such that it is desirable to provide a combination play table and storage container for the building blocks which is easily transportable and which can, for instance, be easily erected to form a play table for use in an automobile, in a room other than the room in which the TABLE TOYS play table described in the preceding paragraph may be used, or in any other location. It is this need to which the apparatus of the present invention is directed.

Specifically, an object of the present invention is to provide a combination storage container and play table for interlocking building blocks. It is another object of the present invention to provide such a storage container and play table which can be erected to form a table having a top surface on which the blocks are played with.

Other objects, and the advantages of the present invention, will be apparent to those skilled in the art from the following description of the presently preferred embodiment thereof.

SUMMARY OF THE INVENTION

An easily transportable play table and storage container apparatus for use with children's interlocking building blocks comprising a frame having a surface on one side thereof adapted for playing with interlocking building blocks thereon and a compartment pivotally mounted to the frame for storing the interlocking building blocks therein when they are not being played with. The compartment pivots from a first, closed position in which the walls of the compartment are adjacent the side of the frame opposite the playing surface for transporting the apparatus and a second, open position wherein the compartment forms a substantially vertical leg for supporting the frame at a level above the surface in which the compartment rests to facilitate playing with the building blocks on the playing surface of the frame. Also provided is means for retaining the compartment in the first, closed position.

BRIEF DESCRIPTION OF THE DRAWINGS

FIG. 1 is a perspective view of the apparatus of the present invention in the first, closed position for easy transportation thereof.

FIG. 2 is a perspective view of the apparatus of the present invention having the storage compartment unfolded to the second, open position for supporting the frame to which the compartments are pivotally mounted.

DETAILED DESCRIPTION OF THE PREFERRED EMBODIMENT

Figure 3:
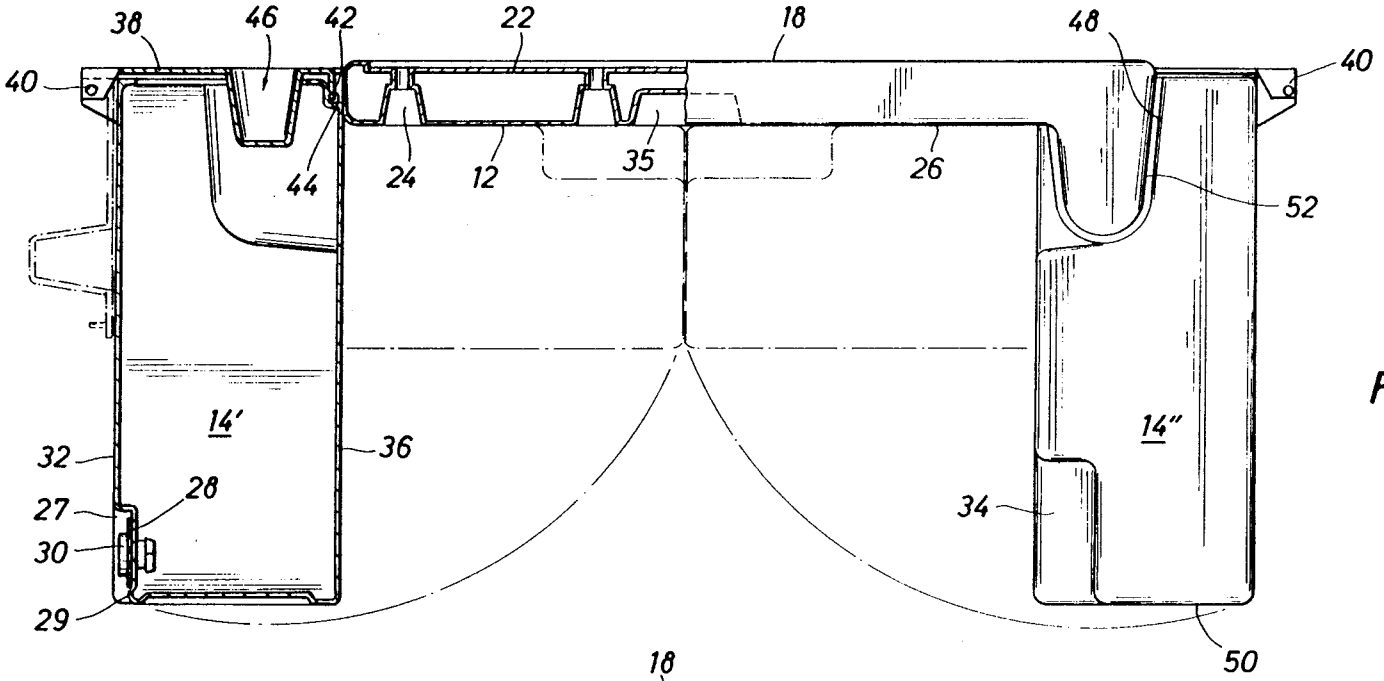
FIG. 3 is a partial sectional/end view of the apparatus of FIG. 1 taken along the lines 3—3 in FIG. 2.

Referring now to the figures, there is shown a presently preferred embodiment, indicated generally at reference numeral 10, of the apparatus of the present invention. The apparatus 10 is comprised of two major components, a frame 12 and a compartment 14 pivotally mounted to the frame 12 by the hinges 16 at either end thereof. In the presently preferred embodiment shown in the figures, the apparatus 10 is provided with two compartments 14' and 14'', but those skilled in the art will recognize that structure including one, two, or more of the compartments 14 could be provided to function in substantially the same manner to achieve substantially the same result intended for the two compartments 14' and 14'' that are shown.

The frame 12 is provided with a surface on the top side thereof which is adapted for playing with interlocking building blocks of the type supplied by several manufacturers under the trademarks TYCO, DUPLO, LEGO, and TANDEM (not shown). This playing surface 18 is preferably formed from one or more plates 22 inset in a shallow cavity formed in the top of frame 12, each plate 22 being provided with a plurality of regularly spaced projections 20 (only a portion of the plate 22 forming playing surface 18 is shown with the projections 20 thereon), the spacing of the projections 20 being such that the playing surface 18 is adapted for receiving the interlocking building blocks of the types described above thereon. As shown in more detail in FIG. 3, the plate 22 is affixed to the top surface of frame 12 by a plurality of screws (not shown) received through the holes (not numbered) in the dimples 24 formed in the bottom of frame 12 for that purpose. The plate 22 may also be provided with a split collar (not shown) for receiving the screws therein, the split portions of the collar spreading as the screw is tightened to engage the walls of the hole in frame 12 or an arrow head (snap fit) projection for engaging the frame 12 around the bottom of the holes.

Figure 4:
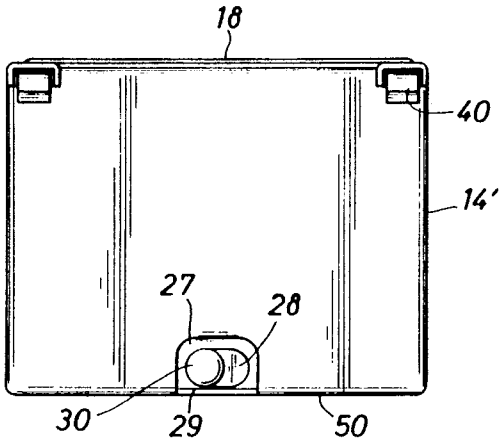
FIG. 4 is an end, elevational view of the apparatus of FIG. 2.

As shown in FIG. 1, the compartments 14 mounted to either end of frame 12 are pivoted to a first, closed position in which the inside walls 36 of the compartments 14 are adjacent the side 26 (see FIG. 3) of frame 12 opposite the playing surface 18 for transporting the storage container 10. The compartments 14' and 14'' are held in this first, closed position by a latch 28 mounted on a pivot pin 30 which is rotatably mounted in the outside wall 32 of compartment 14' as shown in FIGS. 3 and 4. The latch 28 is retained in the position shown in FIG. 4 by a ridge 29 formed at the bottom edge of the depression 27 in the outside wall 32 of compartment 14'. The latch 28 engages the flat surface 31 formed in a depression in the outside wall 32 of the compartment 14'' (see FIG. 2) to retain both compartments 14' and 14'' in the closed position shown in FIG. 1. A hand grip, or indentation, 34 is formed in the inside wall 36 of each compartment 14 for facilitating the pivoting of the compartments 14 from the first, closed position to the second, open position shown in FIG. 2.

When folded to this first, folded position (shown in FIG. 1 and in shadow lines in FIG. 3), the compartments 14' and 14'' and frame 12 form a convenient, generally rectangularly-shaped, easily transportable storage container for the toy building blocks. To facilitate the carrying of this container from place to place, a hand-hold 35 (FIG. 3) is formed in the underside of frame 12 at a location convenient for receiving the fingertips of the person carrying the container.

Each of the compartments 14 forms a substantially elongate, rectangular bin for receiving the interlocking building blocks therein when not being played with. Each bin, or compartment 14, is provided with a lid 38 mounted to the outside wall 32 of the compartment 14 on hinges 40. The lids 38 of each compartment 14 are provided with a lip 42 running along one side thereof having a groove or detent (not numbered) formed in the underside thereof for receiving a tongue, or ridge, 44 formed in the inside wall 36 of the compartment 14 to retain the lid 38 in the position shown in FIG. 1, e.g., closing the compartment 14. The lids 38 are provided with a finger grip 46 having a textured inside surface for facilitating the disengagement of the tongue and groove 44 to open each compartment 14. As shown in FIG. 3, each of the lids 38 can be pivoted 270° around the hinge 40 to occupy the position shown in the shadow lines in that figure so that access to the compartments 14 is not blocked when the lid 38 is opened.

Referring now to FIGS. 2 and 3, it can be seen that the surfaces 48 molded in the inside wall 36 of the compartments 14 and the bearing surfaces 52 of the ends of frame 12 act as stops for the purpose of stabilizing the compartments 14 when positioned in the second, open position to form a substantially vertical leg for supporting the frame 12 at a level above the surface on which the bottom 50 of each of the compartments 14 rest to form a play table to facilitate playing with the building blocks on the playing surfaces 18 of frame 12. For purposes of clarity, the space between the surfaces 48 and the bearing surfaces 52 are exaggerated in FIGS. 2 and 3. To further provide lateral stability to the play table formed by the apparatus 10 when the compartments 14 are in the second, open position, a detent, or depression, shown in shadow lines at reference numeral 54 can be provided in the inside wall 36 of the compartments 14 to resist the movement of the compartments 14 along the arc shown by the shadow lines in FIG. 3 toward the first, closed position shown in FIG. 1.

Although described in terms of the illustrated presently preferred embodiment, those skilled in the art who have the benefit of this disclosure will recognize that certain changes to the component parts of the apparatus 10 can be made without changing the manner in which those parts function to achieve their intended results. For instance, the latch 28 and pivot pin 30 for retaining the compartments 14 in the first, closed position can be replaced by a belt and/or strap which runs through a slot (not shown) in the frame 12 and around the lids 38 and outside walls 32 of the compartments 14 to form both a carrying handle and means for retaining the compartments 14 in the first, closed position. Such a strap has the additional benefit of providing extra security in the closing of the lids 38 of each compartment 14. All such changes are intended to fall within the spirit and scope of the present invention as set out in the following claims.

What is claimed is:

1. A portable playing surface and storage container apparatus for interlocking building blocks comprising:

a frame having a surface on one side thereof adapted for playing with interlocking building blocks thereon;

a compartment formed of inside, outside, and bottom walls, and pivotally mounted to said frame for receiving the interlocking building blocks therein when not being played with for pivoting to a first, closed position in which the inside wall of said compartment is adjacent the side of said frame opposite the playing surface for transporting the apparatus and a second, open position wherein said compartment forms a substantially vertical leg for supporting said frame to form a table having the playing surface at a level above the surface on which the bottom wall of said compartment rests to facilitate playing with the building blocks on the playing surface of the frame;

a lid mounted to the outside wall of said compartment and, when said compartment is in said second, open position, pivotable between a first position closing said compartment and forming the top thereof, the top being substantially co-planar with the playing surface of said frame, and a second, open position allowing access to the inside of said compartment; and means for latching said compartment in said first, closed position.

2. The apparatus to claim 1 additionally comprising means for stabilizing said compartments in said second, open position.

3. The apparatus of claim 2 wherein said stabilizing means additionally comprises a detent formed in the inside wall of said compartment for resisting movement of said compartment from said second, open position toward said first, closed position.

4. The apparatus of claim 1 wherein said latching means comprises a latch mounted on a pivot pin in the outside wall of said compartment.

* * * * *